United States Patent [19]

Shaw

[11] Patent Number: 5,011,596

[45] Date of Patent: Apr. 30, 1991

[54] METHOD OF DEPRESSING READILY FLOATABLE SILICATE MATERIALS

[75] Inventor: Douglas R. Shaw, Denver, Colo.

[73] Assignee: Weyerhaeuser Company, Tacoma, Wash.

[21] Appl. No.: 586,331

[22] Filed: Sep. 19, 1990

Related U.S. Application Data

[63] Continuation-in-part of Ser. No. 489,118, May 5, 1990, abandoned.

[51] Int. Cl.[5] ..... B03D 1/004; B03D 1/106; B03D 1/02

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 3,796,308 | 3/1974 | McIlthinney | 209/167 |
| 4,046,678 | 9/1977 | Zajic | 209/166 |
| 4,269,699 | 5/1981 | McCready | 209/166 |
| 4,775,627 | 10/1988 | Attia | 209/167 |
| 4,853,114 | 8/1989 | Lewis | 209/167 |

FOREIGN PATENT DOCUMENTS

| | | | |
|---|---|---|---|
| 233311 | 2/1986 | German Democratic Rep. | 209/166 |
| 194680 | 4/1967 | U.S.S.R. | 209/167 |
| 923621 | 5/1982 | U.S.S.R. | 209/166 |
| 1115807 | 9/1984 | U.S.S.R. | 209/167 |

OTHER PUBLICATIONS

"Flotability and Leaching of Low Grade Ores with Reagents of Biological Origin", by Solojenken-Academy of Science of Tazik, Dashanbe, USSR-.-1979.

*Primary Examiner*—Stanley Silverman
*Assistant Examiner*—Thomas M. Lithgow

[57] ABSTRACT

The invention resides in the use of a bacterial cellulose as a depressant for readily flotatable silicate minerals in an ore flotation process. Depending on the particular ore being treated, from 0.2–1.5 lb/ton of ore of the bacterial cellulose is effective as a talcose mineral depressant. Usually only about 0.10–0.25 lb/ton of the bacterial cellulose will produce optimum results.

28 Claims, 2 Drawing Sheets

% Au / % TALC (AS MgO)
0
5
10
15
20
25
TALC DEPRESSANT, LB/TON OF ORE
0
0.10
0.20
0.30
0.40
0.50
0.60
0.70
MgO RETAINED
Au RECOVERY
% Au / % MgO
CMC(Au/MgO)
⊙CMC/Au)
×CMC(MgO)
% ORIGINAL Au RECOVERED IN CONCENTRATE
91
92
93
94
95
96
97
98
99
100
% ORIGINAL MgO RETAINED IN CONCENTRATE
5
6
7
8
9
10
11
12
13
14
15

METHOD OF DEPRESSING READILY FLOATABLE SILICATE MATERIALS

This application is a continuation-in-part of my earlier application, Ser. No. 489,118, filed Mar. 5, 1990, and now abandoned.

BACKGROUND OF THE INVENTION

The present invention lies in the field of ore benefication using froth flotation processes. It is particularly directed to the use of a bacterial cellulose as a readily floatable silicate mineral depressant.

A high percentage of the metal ores mined today are of relatively low quality; i.e., the content of the metal-bearing mineral in the ore is very low in relation to the nonmetallic matrix minerals. As one example, it has been calculated that the copper content of a typical city garbage landfill is appreciably higher than that of most of the ores currently being mined. The first significant process step after mining is that of ore benefication. This is a primary separation of the desired metal ore mineral from the great bulk of the gangue in which it naturally occurs. In some parts of the world, especially for high value precious metal ores, an initial hand separation of ore is still made. However, in most locations high labor costs dictate the use of other methods. For most nonferrous minerals, and even in some instances where iron ores are being processed, froth flotation is the preferred method of ore benefication.

In a froth flotation process the ore is first finely ground to release the desired mineral from the gangue in which it is embedded and dispersed. Various conditioning agents may or may not be added during grinding. The ground ore is then dispersed as a high consistency pulp or slurry in water. Various chemical agents are added so that the minerals of value are either selectively wetted or made hydrophobic relative to the other mineral components. After a period of conditioning during which this surface modification of the particles takes place, air in the form of fine bubbles is introduced into the flotation cell. Those particles that are the most hydrophobic will become attached to an air bubble and be carried to the surface where they are held in a froth. The froth is then skimmed to recover the contained material.

Normally it is desirable to depress the waste material into the tailings from the flotation cell with the desired minerals being carried into the froth. However, occasionally the nature of the ore will dictate the reverse procedure. The usual flotation is a continuous process that involves several well defined stages and may include regrinding one or both of the accepted and tailings components. The most usual procedure is to further concentrate the component recovered in the froth from an initial "rougher" stage in one or more "cleaner" stages to further increase the ratio of minerals to matrix rock components. Rougher tailings can be further processed in a "scavenger" flotation if the value of the residual minerals is sufficiently high. The particular flotation process, viewed in its entirety, will depend very much on the mineralogy and economic value of the ore being processed and will be specifically tailored to that situation.

Ore beneficiation processes are usually located very near the mine site to minimize shipping and disposal costs of large amounts of valueless tailings. Since no flotation process is 100% efficient, there is always some loss of the desired mineral in the tailings and this loss occurs at every flotation stage. If the concentrate is to be shipped to a refinery a considerable distance from the mine site it may be more economical to accept a somewhat lower mineral recovery; i.e., higher process losses, in order to make the concentrate grade as high as possible. The savings in shipping costs may well offset the incremental loss of the desires mineral. On the other hand, if the refinery is nearby, a lower grade product may be entirely acceptable in order to maximize recovery. Economic considerations such as these must enter into the design of the flotation unit.

It is very common for an ore to contain economic amounts of several minerals. An example would be copper ores with significant amounts of other useful metals such as lead, zinc, cadmium and smaller quantities of precious metals such as silver and gold. In this case, secondary or tertiary flotation steps may be done to further separate the individual mineral components. An example might be separation of galena, a lead sulfide, from sphalerite, a zinc sulfide. Different chemicals will be required here to float the lead and zinc sulfide separately. An example is described in the paper of Bakinov et al., New Methods of Sulfide Concentrate Upgrading, VII International Minerals Processing Congress, Technical Papers, Sept. 20–24, 1964, Vol. 1, pp 227–23 et seq, Gordon and Breach Science Publishers, Inc. New York. Another paper pertinent to this type separation is Jin et al., Flotation of Sphalerite from Galena with Sodium Carboxymethyl Cellulose as a Depressant, Preprint 87–23, Society of Mining Engineers, Annual Meeting, Feb. 24–27, 1987, Denver, Colo. Reference might also be made to Shaw, U.S. Pat. No. 4,268,380 and Ramadorai and Shaw, U.S. Pat. No. 4,329,223 for general background information on multistage separations using flotation.

Flotation chemicals can be generally classified as collectors, depressants, frothers, and modifiers. Collectors are materials that selectively render hydrophobic the surface of particles to be floated and enable them to become attached to the air bubbles rising to the surface of the cell rather than remaining with the gangue or tailings. Typical collector materials are oleic acid; various xanthate salts such as alkali metal salts of propyl, butyl or amyl xanthate; salts of thiocarboxylic acids; mercaptans; and dialkyldithiophosphates. Choice of the collector will depend very much on the nature of the minerals to be recovered in the froth; e.g., sulfide minerals will usually require different collectors than oxide or carbonate minerals.

Depressants, on the other hand, are materials that selectively modify particle surfaces so that they become hydrophilic; i.e., they inhibit adsorption of collectors and reduce the tendency of the mineral to become attached to the rising air bubbles. These are often natural or synthetic gums or polysaccharides such as guar, arabinogalactans, starch, dextrins, hemicelluloses, sodium carboxymethylcellulose, or sodium cellulose sulfate. Other materials occasionally used are a cuprammonium complex of cellulose, Noke's Reageant (a $P_2S_5$-NaOH reaction product), thiocarboxylic acids, and inorganic materials such as sodium sulfide, sodium silicate, and sodium cyanide.

Frothers are usually water insoluble materials that promote foaming by reducing the surface tension of the water. Among them are monohydric long chain alcohols, various resinates, cresylic acid, terpineol, pine oil and methylisobutyl carbinol.

Modifiers or activators include a wide variety of chemicals having various functions. One such function is to modify the surface of a mineral so that a collector either does or does not adsorb on it. These include materials having such diverse functions as pH adjustment, removal of a collector from mineral surfaces between different flotation stages, etc. Activated carbon would be an example of a material intended for the last mentioned use as is described in the aforementioned patents to Shaw and Ramadorai et al.

The lists of chemicals given above should be regarded as exemplary only and are not intended to be all inclusive.

Among the particularly troublesome minerals to depress into the gangue are those generally classified as readily floatable silicate (RFS) minerals. These are often referred to as talcose minerals and include minerals having a plate-like structure such as talc, phlogopite, and serpentine. Fibrous asbestos group materials such as actinolite and tremolite present similar problems. Ores that present this difficulty are generally referred to as high talc or high RFS ores.

The physical chemistry of flotation processes is extremely complex and is not highly predictable for new ore sources. As one example, Rhodes examines the effect of variables in carboxymethyl cellulose on nickel recovery from an Australian talc containing ore. Significant differences in depressant performance are found depending on the degree of substitution, the degree of polymerization (viscosity) and the temperature history of solutions of the carboxymethyl cellulose used in the process (Rhodes, M. K., in *Mineral Processing*, Proceedings, Part A, Thirteenth International Mineral Processing Congress, Warsaw, June 4–9, 1979, pp 346–367, Elsevier Scientific Publishing Company, New York).

South African patent application No. 882,394 describes the use of hemicellulose obtained from various sources as a talc depressant for ore flotation. This document gives a good basic background description of ore flotation processes.

Carboxymethylcellulose has been known as a readily floatable silicate mineral depressant since the 1940s. Despite its availability in many chemical variations of substitution and molecular weight, and many years of experience with its use and the use of other depressant materials, the mining industry is still looking for new materials that will improve flotation efficiency. Quite unexpectedly the bacterial cellulose product of the present invention appears to serve such a need.

SUMMARY OF THE INVENTION

The present invention comprises the use of a bacterially produced cellulose (BAC) as a depressant for readily floatable silicate minerals in an ore flotation process.

A number of different bacteria are known to produce cellulose as metabolic byproducts. One that is particularly efficient is a bacterium from the genus Acetobacter. Culture of cellulose producing bacteria has normally been carried out on the surface of a static medium. When cultured under agitated conditions these bacteria will normally rapidly mutate to non-cellulose producing strains. However, several stable strains have recently been discovered that are highly resistant to mutation under agitated conditions. This has for the first time enabled large scale production of bacterial cellulose using large aerobic fermenters. Reference may be made to U.S. Pat. No. 4,863,565 for additional details of bacterial cellulose production.

It is preferred to first homogenize or otherwise subject a water suspension of the bacterial cellulose to appreciable shear to thoroughly disperse it before use as a silicate mineral depressant.

The exact amount of bacterial cellulose necessary for effective depression of readily floatable silicate materials will depend on the particular ore and flotation equipment used. It will also depend on whether other depressant chemicals are used in conjunction with the bacterial cellulose. Amounts in the range of 0.01–1.5 lb/ton (0.005–0.75 kg/t) of ore will ordinarily suffice. When bacterial cellulose is used as the only or principal depressant the amounts will preferably be between about 0.05–0.75 lb/ton (0.025–0.38 kg/t) of ore. Amounts in the range of 0.06–0.25 lb/ton (0.03–0.13 kg/t) have given excellent talcose mineral depression on various precious metal ores. When used in conjunction with another depressant, such as carboxymethyl cellulose, lower amounts in the range of 0.02 to 0.20 lb/ton (0.01–0.10 kg/t) have been very effective.

The bacterial cellulose may be added directly to the flotation cell as a water dispersion or it may even be added at some point during grinding of the ore. It may be added simultaneously with the collecting agents, prior to, or subsequent to the addition of collecting chemicals.

It is an object of the present invention to provide a method of depressing readily floatable silicate minerals during an ore flotation process using a bacterial cellulose as a depressant.

It is also an object to provide a readily floatable silicate mineral depressant effective in smaller quantities than those now normally employed.

These and many other objects will become readily apparent upon reading the following detailed description taken in conjunction with the figures.

DETAILED DESCRIPTION OF THE PREFERRED EMBODIMENTS

Figure 1:
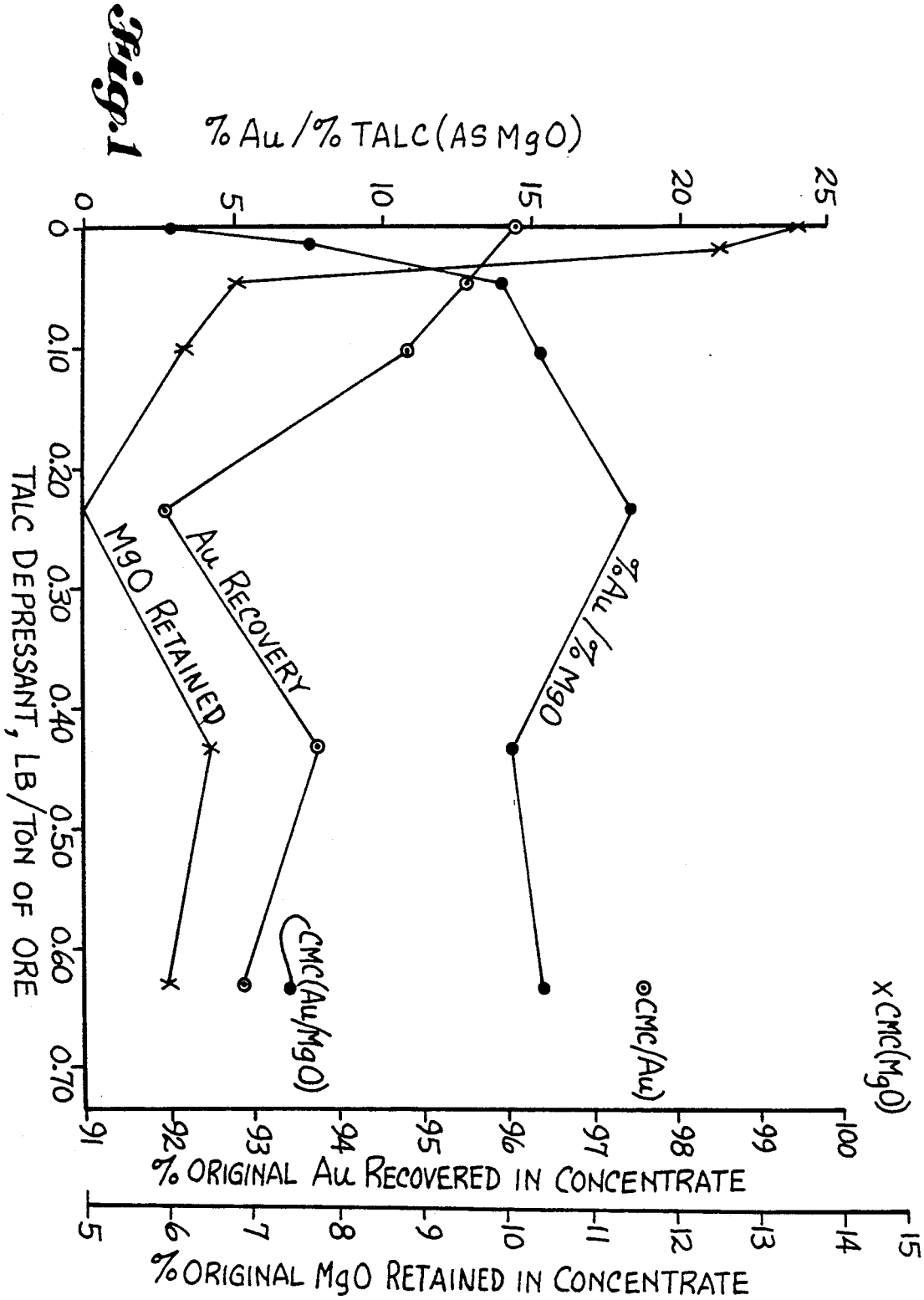
FIG. 1 is a graph showing the effect of a bacterial cellulose silicate depressant on recovery and grade of a gold ore.

It has been known for many years that cellulose can be synthesized by certain bacteria, particularly those of the genus Acetobacter. However, taxonomists have been unable to agree upon a consistent classification of the cellulose producing species of Acetobacter. For example, the cellulose producing microorganisms listed in the 15th Edition of the Catalog of the American Type Culture Collection under accession numbers 10245, 10821 and 23769 are classified both as *Acetobacter aceti* subsp. *xylinum* and as *Acetobacter pasteurianus*. For the purposes of the present invention any species or variety of bacterium within the genus Acetobacter that will produce cellulose should be regarded as a suitable cellulose producer for the purposes of the present invention.

EXAMPLE 1

PRODUCTION OF BACTERIAL CELLULOSE

The bacterial cellulose of the present invention was produced in agitated culture by a strain of *Acetobacter*

*aceti* subsp. *xylinum* grown as a subculture of ATCC Accession No. 53263, deposited Sept. 13, 1985 under the terms of the Budapest Treaty.

The following base medium was used for all cultures. This will be referred to henceforth as CSL medium.

| Ingredient | Final Conc. (mM) |
|---|---|
| $(NH_4)_2SO_4$ | 25 |
| $KH_2PO_4$ | 7.3 |
| $MgSO_4$ | 1.0 |
| $FeSO_4$ | 0.013 |
| $CaCl_2$ | 0.10 |
| $Na_2MoO_4$ | 0.001 |
| $ZnSO_4$ | 0.006 |
| $MnSO_4$ | 0.006 |
| $CuSO_4$ | 0.0002 |
| Vitamin mix | 10 mL/L |
| Carbon source | As later specified |
| Corn steep liquor | As later specified |
| Antifoam | 0.01% v/v |

The vitamin mix was formulated as follows:

| Ingredient | Conc. mg/L |
|---|---|
| Inositol | 200 |
| Niacin | 40 |
| Pyridoxine HCl | 40 |
| Thiamine HCl | 40 |
| Ca Pantothenate | 20 |
| Riboflavin | 20 |
| p-Aminobenzoic acid | 20 |
| Folic acid | 0.2 |
| Biotin | 0.2 |

Corn steep liquor (CSL) varies in composition depending on the supplier and mode of treatment. A product obtained as Lot E804 from Corn Products Unit, CPC North America, Stockton, Calif. may be considered typical and is described as follows:

| Major Component | % |
|---|---|
| Solids | 43.8 |
| Crude protein | 18.4 |
| Fat | 0.5 |
| Crude fiber | 0.1 |
| Ash | 6.9 |
| Calcium | 0.02 |
| Phosphorous | 1.3 |
| Nitrogen-free extract | 17.8 |
| Non-protein nitrogen | 1.4 |
| NaCl | 0.5 |
| Potassium | 1.8 |
| Reducing sugars (as dextrose) | 2.9 |
| Starch | 1.6 |

The pH of the above is about 4.5.

The bacteria were first multiplied as a pre-seed culture using CSL medium with 4% (w/v) glucose as the carbon source and 5% (w/v) CSL. Cultures were grown in 100 mL of the medium in a 750 mL Falcon #3028 tissue culture flask at 30° C. for 48 hours. The entire contents of the culture flask was blended and used to make a 5% (v/v) inoculum of the seed culture. Preseeds were streaked on culture plates to check for homogeneity and possible contamination.

Seed cultures were grown in 400 mL of the above-described medium in 2 L baffled flasks in a reciprocal shaker at 125 rpm at 30° C. for two days. Seed cultures were blended and streaked as before to check for contamination before further use.

The following description is typical of laboratory production of bacterial cellulose. However, the process has been scaled up to fermentors as large as 50,000 L and the material used in the examples to follow has been produced in this larger equipment. There is no discernable difference in the product formed in small or commercial-size reactors.

A continuously stirred 14 L Chemap fermentor was charged with an initial 12 L culture volume inoculated with 5% (v/v) of the seed cultures. An initial glucose concentration of 32 g/L in the medium was supplemented during the 72-hour fermentor run with an additional 143 g/L added intermittently during the run. In similar fashion, the initial 2% (v/v) CSL concentration was augmented by the addition of an amount equivalent to 2% by volume of the initial volume at 32 hours and 59 hours. Cellulose concentration reached about 12.7 g/L during the fermentation. Throughout the fermentation, dissolved oxygen was maintained at about 30% air saturation.

Following fermentation, the cellulose was allowed to settle and the supernatant liquid poured off. The remaining cellulose was washed with deionized water and then extracted with 0.5M NaOH solution at 60° C. for 2 hours. After extraction, the cellulose was again washed with deionized water to remove residual alkali and bacterial cells. More recent work has shown that 0.1M NaOH solution is entirely adequate for the extraction step. The purified cellulose was maintained in wet condition for further use. This material was readily dispersible in water to form a uniform slurry.

The bacterial cellulose produced under stirred or agitated conditions, as described above, has a microstructure quite different from that produced in conventional static cultures. It is a reticulated product formed by a substantially continuous network of branching interconnected cellulose fibers.

The bacterial cellulose prepared as above by the agitated fermentation has filament widths much smaller than softwood pulp fibers or cotton fiber. Typically these filaments will be about 0.05–0.20 μm in width with indefinite length due to the continuous network structure. A softwood fiber averages about 30 μm in width and 2–5 mm in length while a cotton fiber is about half this width and about 25 mm long.

Reference should be made to U.S. Pat. No. 4,863,565 for additional details of bacterial cellulose production.

Samples for flotation tests were chosen from two different precious metal ore sources known to be troublesome for their content of talcose-type readily flotatable silicate (RFS) minerals. One is a California gold ore. The deposit is of relatively complex geology but the ore can be generally described as having gold/silver mineralization in a pyrite matrix with some free gold. Base rock is composed of talcose siliceous minerals of various kinds including sheet silicates, such as magnesium silicates, with feldspar, mica, and small amounts of carbonate minerals.

The other ore is a platinum/palladium/nickel ore. This contains about 1% sulfide minerals which include chalcopyrite, pentlandite, pyrrhotite, and minor amounts of pyrite. Matrix rock is a chlorite-serpentine schist with a sizeable readily flotatable silicate component. The platinum-palladium group metals are found as precious metal sulfides, tellurides, bismuthides and arsenides with some native platinum metal. About 80% of the palladium is found in solid solution in the pentlandite. This is one reason why the flotation properties of the platinum and palladium bearing minerals have been found to be somewhat different.

EXAMPLE 2

An approximate 80 kg sample of California gold ore crushed to-10 mesh particle size was thoroughly blended and then assayed. Assay results showed a gold content of 0.120 oz Au/ton, total sulfide minerals S(T) of 1.51%, and talcose minerals expressed as MgO of 6.995%.

Individual 2 kg ore samples taken from the above sample were ground with water and 0.1 lb/t (0.05 kg/t) $Na_2CO_3$ at 66% solids in a 5×12 inch (127×305 mm) Denver steel ball mill. The ball mill and the subsequently used flotation equipment are available from Denver Equipment Co., Colorado Springs, Colo. The ore was ground for 25 minutes resulting in a product having 98% passing a 200 mesh sieve. The pH during grinding was 8.7.

The entire ground ore sample was placed in a Denver Model D-1 stainless steel flotation cell and diluted to 34% solids to simulate a rougher flotation. At this time flotation chemicals were added as will be described. These are identified as follows. Aerofloat (AF) 25 is an aryl dithiophosphoric acid, Aeroxanthate (AX) 350 is a potassium amyl xanthate, and Aeropromoter (AP) 3477 (used in a later example) is diisobutyldithiophosphate. All of these serve as sulfide mineral collectors and are available from American Cyanamid Co., Wayne, N.J. Aerofloat, Aeroxanthate and Aeropromoter are trademarks of American Cyanamid Co. CMC 6CT is a sodium carboxymethyl cellulose having a nominal 0.6 degree of substitution available from Hercules, Inc., Wilmington, Del. CMC is commonly used as a talcose mineral depressant. MIBC is methylisobutyl carbinol, available from a number of chemical suppliers. This serves as a frother. Bacterial cellulose was produced as described in the preceding example and was thoroughly dispersed with a laboratory mixer prior to use.

Four sequential stages simulating rougher flotation runs were made on each of eight samples. A baseline sample used no readily flotatable silicate (RFS) talcose mineral depressant. Another used 0.35 lb/ton of CMC 6CT in the initial flotation stage and an additional 0.10 lb/ton in each of the subsequent stages. A series of six samples using bacterial cellulose as a RFS depressant used 0.016, 0.032, 0.065, 0.13, 0.24, and 0.35 lb/ton in the initial stage with 0.005, 0.009, 0.018, 0.039, 0.069, and 0.10 lb/ton respectively in each of the following three stages.

At the beginning of the first stage at each depressant usage, 0.03 lb/ton of AF 25 and 0.15 lb/ton of AX 350 collectors, and 0.02 lb/ton MIBC frother were added, followed by one minute conditioning. Then the RFS depressant, if any, was added followed by an additional two minutes conditioning. The cell was then frothed for two minutes and the froth and associated minerals collected.

No additional chemicals were added at the beginning of the second stage except as noted later on Table 1. After two minutes conditioning the cell was frothed for three minutes and the froth collected.

Before the third stage, an additional 0.02 lb/ton of AF 25 and 0.06 lb/ton AX 350 were added, followed by 1 minute conditioning. After the RFS depressant was added, the cell was again conditioned for two minute and then frothed for three minutes.

In the final stage at each depressant level, the noted amount of RFS depressant was added and the cell conditioned for two minutes and frothed for four minutes. The froth products were dried, weighed, prepared, and assayed for each of the four runs at each RFS depressant usage. The tailings from the cell were similarly dried, weighed, prepared and assayed. Based on the weights and assay values of the above recovered samples the head assay was calculated for comparison with the direct head assay of the ore sample. Recoveries or distributions of gold, sulfur and MgO then were calculated.

Table 1 shows a summary of the results of the above tests. The results of Table 1 are also shown graphically on FIG. 1.

TABLE 1

| Test No. | RFS Depressant | Total Depressant Used, lb/ton | Total Flotation Concentrate, Weight % of Feed | Recovery, % Au | Recovery, % S(T) | Recovery, % MgO | Calculated Head(1) Au, 02/t | Calculated Head(1) S(T), % | Calculated Head(1) MgO, % |
|---|---|---|---|---|---|---|---|---|---|
| F-10(2)(4) | None | 0 | 10.66 | 96.1 | 97.6 | 13.4 | 0.138 | 1.49 | 7.89 |
| F-11(3) | CMC 6CT | 0.65 | 10.02 | 97.6 | 98.2 | 14.4 | 0.148 | 1.53 | 6.90 |
| F-19(5) | BAC | 0.03 | 8.40 | 93.3 | 97.2 | 12.4 | 0.137 | 1.62 | 7.21 |
| F-18(5) | BAC | 0.06 | 6.01 | 95.4 | 96.5 | 6.8 | 0.122 | 1.61 | 7.17 |
| F-15(3) | BAC | 0.12 | 7.22 | 94.8 | 94.4 | 6.2 | 0.145 | 1.68 | 7.25 |
| F-14 | BAC | 0.25 | 7.13 | 91.9 | 97.6 | 5.0 | 0.162 | 1.58 | 7.13 |
| F-13 | BAC | 0.45 | 7.43 | 93.7 | 97.4 | 6.5 | 0.118 | 1.41 | 7.19 |
| F-12 | BAC | 0.65 | 7.74 | 92.8 | 98.2 | 6.0 | 0.129 | 1.50 | 6.88 |

Notes to table:
(1)Direct head assay of ore was 0.120 oz Au/ton, S(T) 1.51%, MgO 7.00%
(2)Test No. F-10 had 0.02 lb/ton MIBC added also to second and third flotation stages
(3)Test Nos. F-11 and F-15 had 0.02 lb/ton MIBC added also to second flotation stage
(4)Test No. F-10 had 1 minute total conditioning time for each stage
(5)Test Nos. F-18 and F-19 had only 1 minute conditioning on second and fourth stages The data clearly show that for this particular ore and set of flotation conditions bacterial cellulose is a very effective talcose mineral depressant. As little as 0.06 lb/ton of bacterial cellulose was very useful. This is about a full order of magnitude less than the typical usage of CMC. CMC, which is usually a very good RFS depressant, was in this case completely ineffective, giving results comparable with the baseline sample using no depressant at all. Total gold recovery was somewhat lower when bacterial cellulose was used as the depressant. As was noted earlier, this could be a desirable economic tradeoff where concentrates must be shipped any significant distance to a refinery. FIG. 1 plainly shows the high gold/talcose mineral ratios in the concentrates.

EXAMPLE 3

In like fashion to the California gold ore, a large sample of Montana platinum/palladium ore was crushed to −10 mesh particle size, thoroughly blended, and then assayed. Assay results of a first large sample showed 0.157 oz/ton platinum (Pt), 0.612 oz/ton palladium (Pd), 0.16% sulfide minerals S(T), and 8.315% readily flotatable silicate minerals expressed as MgO. Individual 2 kg samples were drawn from the above large sample and ground in a 5×12 inch batch Denver steel ball mill for 35 minutes at 60% solids. The resultant ground product contained approximately 60 wt. % minus 200 mesh. 0.03 lb/ton of AX 350 and 0.025 lb/ton AP 3477 collectors were added at the beginning of the grinding period. The pulp pH during grinding was 9.6.

The ground mineral was treated in similar fashiion to the California ore samples in order to simulate a rougher flotation operation. The Denver D-1 flotation cell was operated at 34% solids. An additional 0.30 lb/ton of AX 350 and 0.25 lb/ton AP 3477 were added to the ground ore suspension, as was the designated amount of RFS depressant. The suspension was then conditioned for two minutes. Then 0.49–0.75 lb/ton of $H_2SO_4$ was added, to bring pH into the 8.0–8.2 range, as was 0.04 lb/ton MIBC frother. The suspension was then conditioned for an additional two minutes, frothed for four minutes, and the froth and contained mineral concentrate collected. Following collection, frothing was continued an additional four minutes and the concentrate again collected. At this time another addition of 0.03 lb/ton of AX 350 and 0.025 lb/ton AP 3477 was made, followed by two minutes conditioning and four minutes frothing. Following third stage froth collection, a final four minutes frothing was carried out and the concentrate again collected.

The runs made consisted of a baseline sample without any RFS mineral suppressant, samples using 0.10 and 1.00 lb/ton CMC 6CT and samples using 0.03, 0.06, 0.09, 0.125, 0.25, 0.50 and 0.75 lb/ton of bacterial cellulose.

The individual concentrate samples were dried, weighed, and assayed. Results of the above flotation runs are shown in Table 2.

TABLE 2

| Test No. | RFS Depressant | Total Depressant Used, lb/ton | Total Flotation Concentrate, Weight % of Feed | Recovery, % Pt | Recovery, % Pd | Recovery, % MgO | Calculated Head(1) Pt | Calculated Head(1) Pd | Calculated Head(1) MgO |
|---|---|---|---|---|---|---|---|---|---|
| F-34 | None | 0 | 9.35 | 96.8 | 94.2 | 19.2 | 0.171 | 0.636 | 9.08 |
| F-33 | BAC | 0.03 | 7.79 | 95.7 | 95.4 | 16.0 | 0.195 | 0.638 | 9.22 |
| F-32 | BAC | 0.06 | 7.21 | 97.1 | 94.8 | 14.8 | 0.192 | 0.682 | 9.04 |
| F-31 | BAC | 0.09 | 6.72 | 96.8 | 94.5 | 13.2 | 0.173 | 0.644 | 9.02 |
| F-30 | BAC | 0.125 | 3.77 | 92.3 | 90.9 | 6.7 | 0.212 | 0.644 | 9.28 |
| F-29 | BAC | 0.25 | 3.25 | 93.5 | 80.6 | 5.1 | 0.180 | 0.622 | 9.48 |
| F-28 | BAC | 0.50 | 3.11 | 90.8 | 80.1 | 4.2 | 0.157 | 0.569 | 9.21 |
| F-27 | BAC | 0.75 | 4.38 | 90.1 | 88.2 | 5.3 | 0.193 | 0.643 | 9.19 |
| F-26 | BAC | 1.00 | 3.73 | 90.2 | 85.5 | 4.1 | 0.196 | 0.656 | 9.54 |
| F-47(2) | BAC | 0.25 | 4.14 | 94.7 | 90.4 | 6.7 | 0.219 | 0.642 | 9.24 |

Notes to table:
(1)Direct head assay 0.157 oz/ton Pt, 0.612 oz/ton Pd
(2)0.25 lb/ton $CuSO_4$ added to fourth flotation stage The following observations can be made on the above data. It is immediately apparent that bacterial cellulose serves as an effective depressant for the readily floatable silicate component when used in amounts of 0.125 lb/ton or greater. Under the conditions used, platinum recovery is somewhat higher than palladium. This is most probably related to the mineralogy of the ore in which platinum sulfide occurs as discrete particles whereas palladium cooccurs with nickel sulfide in the pentlandite component. Since this is not an optimized system, by varying other flotation conditions it is fully expected that recovery of one or both metals can be significantly raised. As one example, palladium recovery was increased by adding a small amount of copper sulfate to the fourth extraction stage.

Figure 2:
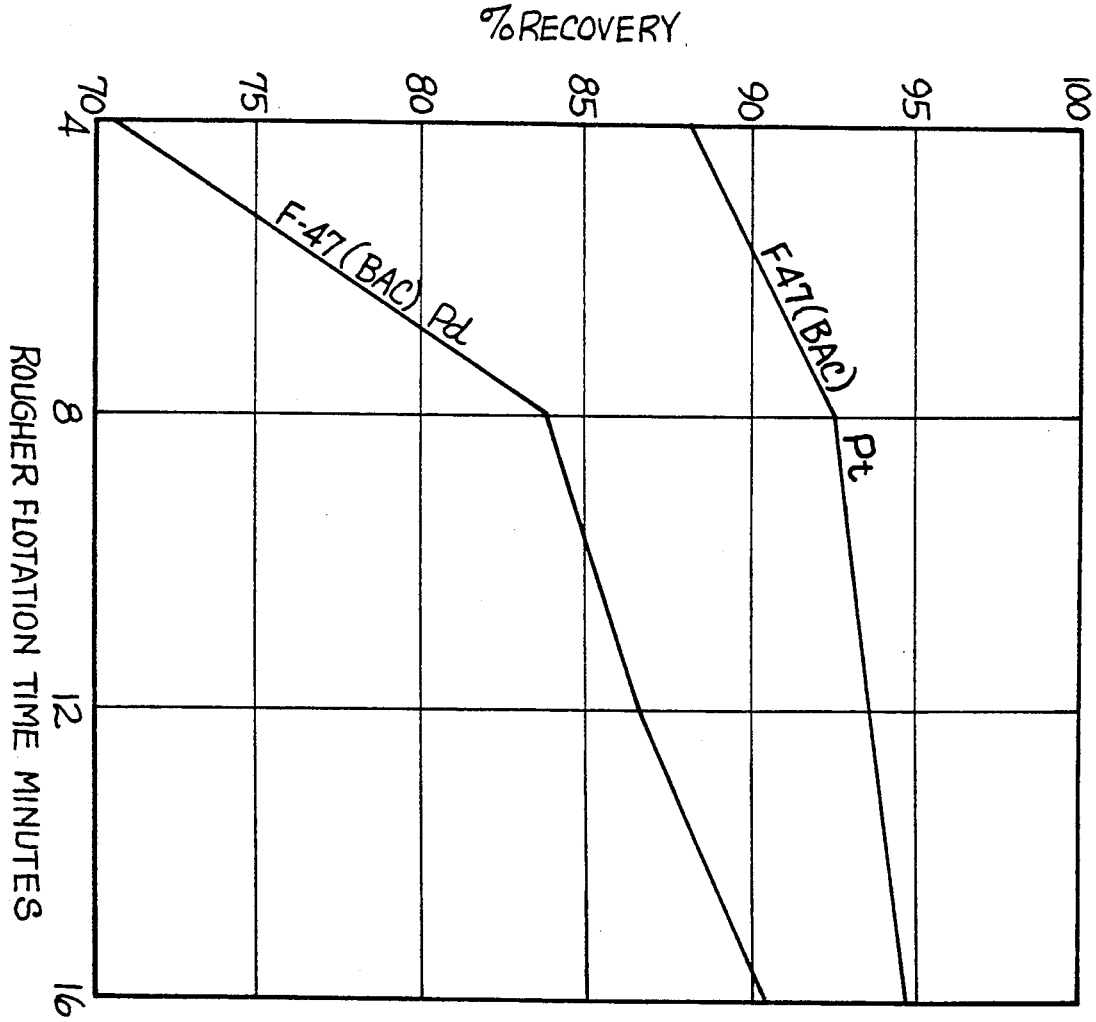
FIG. 2 is a graph showing the recovery as a function of flotation time for a platinum/palladium ore.

Perhaps associated with the somewhat lower palladium recovery was the observation that its recovery rate was noticeably lower than that of platinum. Stated otherwise, the palladium associated minerals required a longer flotation time than the platinum minerals. This is shown in graph form in FIG. 2.

EXAMPLE 4

A comparison was made between different fermenter lots of bacterial cellulose to ascertain consistency of performance. Tests were made on a different sample of Montana Pt/Pd ore but using the same flotation procedure and chemicals described in Example 3. Bacterial cellulose Lot No. NS 01-04 was made in a 50,000 liter agitated fermenter and was treated twice during purification with a caustic soda lysing step. All of the G-numbered batches were made in a 5000 L fermenter and were given only one caustic lysing treatment during purification. Results of the comparisons involving four different batches at six different usage levels are given in Table 3.

TABLE 3

| Test No. | BAC Lot No. | Depressant Usage, lb/t | Recovery, % Pt | Recovery, % Pd | Recovery, % MgO | Recovery, % Ni | Calculated Head Pt, Oz/t | Calculated Head Pd, Oz/t | Calculated Head MgO, % | Calculated Head Ni, % |
|---|---|---|---|---|---|---|---|---|---|---|
| 2 | — | None | 89.7 | 90.7 | 12.1 | 60.0 | 0.119 | 0.436 | 8.21 | 0.073 |
| 7 | NS 01-04 | 0.09 | 94.0 | 94.5 | 11.6 | 62.2 | 0.142 | 0.461 | 7.90 | 0.070 |
| 5 | NS 01-04 | 0.125 | 90.7 | 91.7 | 10.9 | 60.4 | 0.122 | 0.410 | 7.89 | 0.074 |
| 12 | G-345 | 0.125 | 95.1 | 93.0 | 7.4 | 59.3 | 0.117 | 0.396 | 8.52 | 0.071 |
| 21 | G-345 | 0.18 | 94.5 | 86.9 | 5.0 | 51.6 | 0.106 | 0.388 | 8.20 | 0.074 |

TABLE 3-continued

| Test No. | BAC Lot No. | Depressant Usage, lb/t | Recovery, % Pt | Pd | MgO | Ni | Calculated Head Pt, Oz/t | Pd, Oz/t | MgO, % | Ni, % |
|---|---|---|---|---|---|---|---|---|---|---|
| 6 | NS 01-04 | 0.25 | 90.0 | 91.6 | 8.0 | 59.4 | 0.124 | 0.443 | 7.84 | 0.071 |
| 9 | G-345 | 0.25 | 92.1 | 80.9 | 4.7 | 59.2 | 0.110 | 0.386 | 8.26 | 0.062 |
| 10 | G-234 | 0.25 | 89.7 | 79.2 | 4.4 | 54.7 | 0.141 | 0.464 | 8.55 | 0.062 |
| 11 | G-005 | 0.25 | 92.6 | 82.3 | 4.4 | 61.3 | 0.119 | 0.419 | 8.56 | 0.060 |
| 8 | NS 01-04 | 0.35 | 92.3 | 83.6 | 5.5 | 49.8 | 0.125 | 0.423 | 6.68 | 0.073 |
| 14 | G-345 | 0.50 | 94.5 | 76.6 | 2.9 | 39.9 | 0.107 | 0.402 | 8.06 | 0.078 |

Direct Head Assay; 0.101 oz/t Pt, 0.454 oz/t Pd, 0.067% Ni, 8.12% MgO
Pulp pH during grinding 9.1-9.7
$H_2SO_4$ in second conditioning 0.35-0.66 lb/t to adjust pH to 8.1-8.2

In all cases where at least 0.125 lb/ton of bacterial cellulose was used, its effectiveness as a talcose mineral depressant is readily apparent as judged by the reduced MgO content of the recovered concentrate. Platinum recovery is consistent regardless of the amount of BAC depressant used. However, palladium recovery appears to decrease somewhat with increasing amounts of BAC depressant. Judging again from MgO assays of the concentrate, the G-numbered lots of bacterial cellulose seem somewhat more effective than Lot No. NS 01-04 as talcose mineral depressants. All of the G-numbered lots appeared to perform about equally well. The reasons for this difference are not readily apparent but may relate to the purification procedure.

EXAMPLE 5

The prevailing wisdom in the art would suggest that the best recovery efficiency with an ore of the Montana type would be achieved by operating the rougher flotation slightly above neutral pH. This may not be always be the case when bacterial cellulose is used as the talcose mineral depressant. A series of runs was made using the procedure of the previous Montana ore examples with the difference that flotation pH was raised to about 9.8 by the addition of soda ash instead of sulfuric acid to the second conditioning step. Results are seen in Table 4. All runs were made using 0.25 lb/ton bacterial cellulose from Lot No. G-345.

TABLE 4

| Test No. | BAC Lot No. | $Na_2CO_3$[1] lb/t | Recovery, % Pt | Pd | MgO | Ni | Calculated Head Pt, Oz/t | Pd, Oz/t | MgO, % | Ni, % |
|---|---|---|---|---|---|---|---|---|---|---|
| 6 | NS 01-04 | None | 90.9 | 91.6 | 8.0 | 59.4 | 0.124 | 0.443 | 7.84 | 0.071 |
| 9 | G-345 | None | 92.1 | 80.9 | 4.7 | 59.2 | 0.110 | 0.386 | 8.26 | 0.062 |
| 10 | G-234 | None | 89.7 | 79.2 | 4.4 | 54.7 | 0.141 | 0.464 | 8.55 | 0.062 |
| 11 | G-005 | None | 92.6 | 82.3 | 4.4 | 61.3 | 0.119 | 0.419 | 8.56 | 0.060 |
| 23[2] | G-345 | 0.5 | 94.7 | 92.9 | 5.7 | 59.4 | 0.111 | 0.395 | 7.91 | 0.069 |
| 34[3] | G-008 | 0.5 | 95.4 | 91.2 | 6.8 | 62.3 | 0.125 | 0.447 | 8.58 | 0.077 |
| 35[3] | G-011 | 0.5 | 95.3 | 91.6 | 5.9 | 68.3 | 0.123 | 0.436 | 8.55 | 0.061 |
| 36[3] | G-013 | 0.5 | 85.9 | 83.8 | 7.0 | 67.7 | 0.137 | 0.471 | 8.80 | 0.119 |
| 37[3] | G-014 | 0.5 | 94.8 | 92.5 | 7.6 | 61.5 | 0.111 | 0.410 | 8.63 | 0.072 |

Direct Head Assay: 0.101 oz/t Pt, 0.454 pz/t pd, 0.067% Ni, 8.12% MgO
All runs used 0.25 lb/t BAC
[1]Added in place of $H_2SO_4$ to second conditioning, pH 9.8.
[2]BAC added to first conditioning
[3]BAC added to grind, pH 9.5

The use of a higher flotation pH has resulted in significant increases in recovery of platinum, palladium and nickel. Somewhat higher levels of MgO were also noted in the concentrate. A summary of the average recoveries of these minerals in the concentrates from the trials at the two pH levels (taken from Table 4) is given in Table 5.

TABLE 5

| | Platinum, % | Palladium, % | MgO, % | Nickel, % |
|---|---|---|---|---|
| pH 8.2 | 91.5 | 80.8 | 4.5 | 58.4 |
| pH 9.8 | 93.2 | 90.4 | 6.6 | 63.8 |

EXAMPLE 6

It was observed earlier (Run F-47 on Table 2) that the addition of a small amount of copper sulfate activator to the fourth rougher stage appeared to result in increased palladium recovery. This effect was investigated further using the second Montana ore sample with various amounts and points of addition of $CuSO_4$. Results and conditions used are given in Table 6.

TABLE 6

| Test No. | $CuSO_4$ Usage lb/t | Point of $CuSO_4$ Addition | Recovery, % Pt | Pd | MgO | Ni | Calculated Head Pt, Oz/t | Pd, Oz/t | MgO, % | Ni, % |
|---|---|---|---|---|---|---|---|---|---|---|
| 0 | None | — | 92.1 | 80.9 | 4.7 | 59.2 | 0.110 | 0.386 | 8.26 | 0.062 |
| 13[2] | 0.25 | 4th Stage | 95.8 | 88.3 | 4.6 | 52.2 | 0.138 | 0.416 | 8.76 | 0.073 |
| 22[2] | 0.5 | 4th Stage | 93.4 | 89.0 | 4.6 | 56.4 | 0.133 | 0.417 | 7.96 | 0.076 |
| 24[2] | 0.5 | 4th Stage[1] | 90.4 | 85.3 | 3.6 | 55.7 | 0.122 | 0.427 | 8.21 | 0.064 |
| 18 | 0.25 | 1st Cond. | | | | | | | | |
| | 0.5 | 4th Stage | 83.7 | 88.3 | 4.1 | 53.1 | 0.090 | 0.393 | 8.14 | 0.079 |
| 17[2] | 0.5 | 3rd Stage | | | | | | | | |

TABLE 6-continued

| Test No. | $CuSO_4$ Usage lb/t | Point of $CuSO_4$ Addition | Recovery, % Pt | Pd | MgO | Ni | Calculated Head Pt, Oz/t | Pd, Oz/t | MgO, % | Ni, % |
|---|---|---|---|---|---|---|---|---|---|---|
| | 0.5 | 4th Stage | 93.0 | 85.4 | 4.1 | 47.4 | 0.125 | 0.427 | 8.14 | 0.085 |

Direct Head Assay; 0.101 oz/t. Pt, 0.454 oz/t pd, 0.067% Ni, 8.12% MgO
All Lot G345 BAC with 0.25 lb/t usage
(1)pH reduced to 7.0 with $H_2SO_4$ in 3rd stage
(2)In runs 13, 17, 22 and 24 0.03 lb/t AX-350 and 0.025 lb/t were added in each of the third and fourth flotation steps. Samples were conditioned five minutes after addition of the collectors, then $CuSO_4$ was added, then the pulp suspension was conditioned an additional two minutes prior to frothing.

There appears to be a significant improvement in palladium recovery and platinum recovery is at least as good as without the use of $CuSO_4$. Talcose mineral depression appears superior as measured by the lower MgO content. Only nickel recovery appears to be adversely affected. Throughout the data of Examples 4–6 it will be seen that nickel recovery is quite variable. This is probably due, at least in part, to the particular mineralogy of this ore sample in which about half of the nickel is in silicate form.

EXAMPLE 7

The method of treatment of the bacterial cellulose prior to use has been found to have a significant effect on its performance. Efficiency of talcose mineral depression and metal recovery is increased by first thoroughly homogenizing an aqueous suspension of the bacterial cellulose. The term "homogenization" is used in the context of preparing a very thorough and smooth-appearing dispersion. Normally homogenization requires a greater shearing energy input than would be achieved by a typical stirrer or agitator. This can be accomplished in any of a number of standard devices designed to impart relatively high shear to a suspension. One that has been effectively used in the laboratory is manufactured by APV Gaulin, Model No. 15M, Wilmington, Massachusetts. Three passes were made of an approximately 0.5% bacterial cellulose suspension at 8000 psi ($5.52\times10^3$ kPa). As homogenization takes place an initial increase in viscosity will occur. Viscosity will soon level off without further significant increase as additional shearing energy is put into the suspension. It does not appear to be further beneficial to continue to add shearing energy beyond the leveling off point. Viscosity can be measured by any conventional means such as with a Brookfield Viscometer, available from Brookfield Engineering Laboratories, Stoughton, Mass.

Tables 7, 7A, and 7B show results of experiments comparing homogenized bacterial cellulose suspensions with BAC that was simply well dispersed using a standard laboratory mixer. These tests were made using BAC by itself and in admixture with CMC. The platinum/palladium ore sample of Example 4 was also used for this test. Table 7 lists depressant usage and preparation conditions. Table 7A gives analyses of concentrates, and Table 7B gives mineral recoveries. In reference to recovery, these laboratory tests were conducted by taking all of the recovered concentrate from the rougher cell and further treating it in the cleaner cell. There was no recycle of any material nor further treatment of depressed gangue minerals.

TABLE 7

| Test No. | Depressant, lb/ton BAC | CMC* | Homogenization | Replicate Tests |
|---|---|---|---|---|
| B10 | 0 | 0 | No | 2 |
| B9 | 0 | 0.05 | No | 2 |
| B7 | 0.2 | 0 | No | 4 |
| B5 | 0.2 | 0.05 | No | 4 |
| B3 | 0.2 | 0 | Yes | 4 |
| B1 | 0.2 | 0.05 | Yes | 4 |

*Hercules grade 7LT.

TABLE 7A

| Test No. | BAC | CMC | HOM | Rougher Concentrate(1) Weight %(2) | Pt | Pd | MgO | Cu | Cleaner Concentrate(1) Weight %(2) | Pt | Pd | MgO | Cu |
|---|---|---|---|---|---|---|---|---|---|---|---|---|---|
| B10 | − | − | − | 4.9 | 2.2 | 7.6 | 17.6 | 0.6 | 2.4 | 4.4 | 14.2 | 19.2 | 1.0 |
| B9 | − | + | − | 4.7 | 2.2 | 7.8 | 17.9 | 0.7 | 2.0 | 5.1 | 17.1 | 19.0 | 1.5 |
| B7 | + | − | − | 2.9 | 4.0 | 12.4 | 15.6 | 1.1 | 1.0 | 11.1 | 32.9 | 15.6 | 3.0 |
| B5 | + | + | − | 3.0 | 3.1 | 10.4 | 14.3 | 1.0 | 0.6 | 15.6 | 47.5 | 10.8 | 4.6 |
| B3 | + | − | + | 2.7 | 4.3 | 12.5 | 12.4 | 1.0 | 0.4 | 26.8 | 70.4 | 6.4 | 5.9 |
| B1 | + | + | + | 2.3 | 4.5 | 13.5 | 12.5 | 1.2 | 0.3 | 34.5 | 88.4 | 3.8 | 8.0 |

(1)Pt and Pd are in units of troy oz/ton concentrate. MgO and Cu are in units of % of concentrate.
(2)Weight % of original ore fed to flotation units.
(3)Percentage of originally present mineral recovered.

TABLE 7B

| Test No. | BAC | CMC | HOM | Rougher Recovery, %(3) Pt | Pd | MgO | Cu | Cleaner Recovery, Pt | Pd | MgO | Cu |
|---|---|---|---|---|---|---|---|---|---|---|---|
| B10 | − | − | − | 97.6 | 94.4 | 11.1 | 86.3 | 94.5 | 86.8 | 6.0 | 81.2 |
| B9 | − | + | − | 96.2 | 94.0 | 10.6 | 84.4 | 93.7 | 87.7 | 4.8 | 80.2 |
| B7 | + | − | − | 95.3 | 91.1 | 5.7 | 83.0 | 91.7 | 82.9 | 2.0 | 75.7 |
| B5 | + | + | − | 94.0 | 89.0 | 5.5 | 83.0 | 88.6 | 75.5 | 0.8 | 75.7 |
| B3 | − | − | + | 94.7 | 86.3 | 4.3 | 83.2 | 88.0 | 72.2 | 0.4 | 72.4 |
| B1 | + | + | + | 93.1 | 85.6 | 3.7 | 82.2 | 84.5 | 66.5 | 0.2 | 67.8 |

(1)Pt and Pd are in units of troy oz/ton concentrate. MgO and Cu are in units of % of concentrate.
(2)Weight % of original ore fed to flotation units.
(3)Percentage of originally present mineral recovered.

From the data of Tables 7A and 7B it is readily apparent that homogenization or addition of shearing energy to the bacterial cellulose dispersion results in a very significant improvement in talcose mineral depression and increased recovery of the desired minerals. MgO content of the cleaner concentrate is about ⅓ that of CMC alone or unhomogenized BAC alone, and about ½ or less than that of the unsheared BAC/CMC mixture. The combination of homogenized BAC and CMC appears to be the most effective treatment. As was noted in the earlier examples, BAC appears to have a negative effect on palladium recovery. This loss of palladium was more pronounced in the cleaner stage.

While results of the tests are not given here numerically, there were no apparent differences in performance if the BAC was homogenized separately or in admixture with CMC.

The bacterial cellulose is normally treated with 0.05% sorbic acid to retard any bacterial or fungal degradation. Tests made using BAC with and without sorbic acid showed that this additive had no effect on flotation results.

EXAMPLE 8

In an effort to overcome the negative effect on palladium recovery while retaining the other advantages of bacterial cellulose, the BAC/CMC ratio was varied. Homogenized BAC usage was lowered to 0.05 lb/ton of ore and CMC usage set at 0.3 to 0.4 lb/ton, about one half of the customary CMC usage. Test conditions were otherwise similar to those of the preceeding example. Results are given as follows in Table 8.

TABLE 8

| Test | Depressant, lb/ton | | Cleaner Concentrate | | Pd Re- | Rougher Re- |
|---|---|---|---|---|---|---|
| No. | BAC | CMC | Pt + Pd | MgO | covery, % | covery, Pd, % |
| B28 | 0 | 0.75 | 85.0 | 3.9 | 78.0 | 86.6 |
| B35 | 0.05 | 0.30 | 102.5 | 3.2 | 84.2 | 89.6 |
| B36 | 0.05 | 0.40 | 93.0 | 3.7 | 82.8 | 90.5 |

It is apparent from the above results that adjustment of the ratio between bacterial cellulose and CMC has overcome the problem of palladium depression. Overall MgO depression and metal recovery results are excellent.

It should be noted that none of the conditions used for either ore sample are represented as being optimum. Instead, they represent trials based on professional knowledge and experience of conditions that would at least be generally suitable for ores of the type studied. Many possible variations await further trial. Regardless of these improvements that can still be expected in its performance, bacterial cellulose has already been found to be an effective readily flotatable silicate mineral depressant for use in ore flotation. It also appears to be more efficient on a weight basis than carboxymethyl cellulose since amounts as much as an order of magnitude less appear to give equivalent performance in some cases. Bacterial cellulose appears to have an additional advantage over CMC. CMC tends to be very sensitive to its point and time of addition. It appears to be readily physically abraded from the readily floatable silicate surfaces by mixing effects. Bacterial cellulose seems to be significantly less sensitive to conditioning time and point of addition relative to collectors than CMC.

It will thus be apparent to those skilled in the art that many variations which have not been exemplified will still fall within the scope and spirit of the invention.

We claim:

1. A method of depressing readily floatable silicate minerals in a froth flotation process of an ore containing said readily floatable silicate minerals and at least one value mineral which comprises subjecting a ground aqueous mineral pulp of said ore to froth flotation in the presence of a sufficient amount of a bacterial cellulose to depress the readily flotable silicate minerals into the flotation tailings and recovering the at least one value mineral in the froth.

2. The method of claim 1 in which the bacterial cellulose is produced by a cellulose generating strain by a bacterium of the genus Acetobacter.

3. The method of claim 2 in which said bacterial cellulose is produced in an agitated culture.

4. The method of claim 3 in which said Acetobacter strain is selected from one resistant to mutation to non-cellulose producing types under agitated culture conditions.

5. The method of claim 1 in which the bacterial cellulose is used in an amount of 0.01 to 1.5 lb/ton (0.005 to 0.75 kg/t) of initial ore feed.

6. The method of claim 5 in which the bacterial cellulose is used in the range of 0.02 to 0.75 lb/ton (0.01 to 0.38 kg/t) of initial ore feed.

7. The method of claim 1 in which the bacterial cellulose is added to the flotation cell as a water dispersion.

8. The method of claim 1 in which the ore is ground with the bacterial cellulose prior to forming the aqueous mineral pulp.

9. The method of claim 1 in which an aqueous suspension of the bacterial cellulose is subjected to shearing energy prior to use.

10. The method of claim 9 in which shearing energy is employed until the point at which the increase in viscosity of the suspension reaches a levelling off point.

11. The method of claim 1 in which the bacterial cellulose is used in combination with carboxymethyl cellulose.

12. A method of depressing readily floatable silicate minerals in a froth flotation process of an ore containing at least one value mineral and said readily floatable silicate mineral which comprises:

grinding the ore to a sufficient degree of fineness;

mixing the ground ore in water to provide an aqueous mineral pulp;

adding sufficient amounts of frother and value mineral collector agents to the aqueous pulp;

further adding an effective readily floatable silicate depressant amount of a bacterial cellulose to the pulp;

conditioning and frothing the mineral pulp in a flotation cell to raise the value mineral into the froth; and skimming the froth to recover a concentrate of the valve mineral, whereby the bacterial cellulose promotes depression of said readily floatable silicate minerals in the ore into the flotation tailings to reduce the amount of said silicates carried into the froth.

13. The method of claim 12 in which the bacterial cellulose is produced by a cellulose generating strain by a bacterium of the genus Acetobacter.

14. The method of claim 13 in which said bacterial cellulose is produced in an agitated culture.

15. The method of claim 14 in which said Acetobacter strain is selected from one resistant to mutation to non-cellulose producing types under agitated culture conditions.

16. The method of claim 12 in which the bacterial cellulose is used in an amount of 0.01 to 1.5 lb/ton (0.005 to 0.75 kg/t) of initial ore feed.

17. The method of claim 16 in which the bacterial cellulose is used in the range of 0.02 to 0.75 lb/ton (0.01 to 0.38 kg/t) of initial ore feed.

18. The method of claim 12 in which the bacterial cellulose is added to the flotation cell as a water dispersion.

19. The method of claim 12 in which an aqueous suspension of the bacterial cellulose is subjected to shearing energy prior to use.

20. The method of claim 19 in which shearing energy is employed until the point at which the increase in viscosity of the suspension reached a levelling off point.

21. The method of claim 12 in which the bacterial cellulose is used in combination with carboxymethyl cellulose.

22. A method of depressing readily floatable silicate minerals in a froth flotation process of an ore containing at least one value mineral and said readily flotable silicate minerals which comprises; adding an effective readily floatable silicate depressant amount of a bacterial cellulose to the ore; grinding the ore to a sufficient degree of fineness; mixing the ground ore in water to provide an aqueous mineral pulp; adding sufficient amounts of frother and value mineral collector agents to the aqueous pulp; conditioning and frothing the mineral pulp in a flotation cell to raise the value mineral into the froth; and skimming the froth to recover a concentrate of the value mineral, whereby the bacterial cellulose promotes depression of said readily floatable silicate minerals in the ore into the flotation tailings to reduce the amount of said silicates carried into the froth.

23. The method of claim 22 in which the bacterial cellulose is used in an amount in the range of of 0.01 to 1.5 lb/ton (0.005 to 0.75 kg/t) of initial ore feed.

24. The method of claim 22 in which the bacterial cellulose is used in the range of about 0.02 to 0.75 lb/ton (0.01 to 0.38 kg/t) of initial ore feed.

25. The method of claim 22 in which the bacterial cellulose is added to the flotation cell as a water dispersion.

26. The method of claim 22 in which an aqueous suspension of the bacterial cellulose is subjected to shearing energy prior to use.

27. The method of claim 26 in which shearing energy is employed until the point at which the increase in viscosity of the suspension reaches a levelling off point.

28. The method of claim 22 in which the bacterial cellulose is used in combination with carboxymethyl cellulose.

* * * * *

UNITED STATES PATENT AND TRADEMARK OFFICE

CERTIFICATE OF CORRECTION

PATENT NO. : 5,011,596

DATED : April 30, 1991

INVENTOR(S) : Douglas R. Shaw

It is certified that error appears in the above-identified patent and that said Letters Patent is hereby corrected as shown below:

In Abstract, line 2, "flotatable" should read --floatable--;

In column 1, line 10, "benefication" should read --beneficiation--;

In column 1, line 21, "benefication" should read --beneficiation--;

In column 1, line 30, "benefication" should read --beneficiation--;

In column 2, line 27, "227-23 et seq" should read --227 et seq--

In column 5, line 19 was omitted / should read --The final pH of the medium was 5.0 + 0.2.--;

In column 8, line 40, "02/t" should read --Oz/t--.

In column 10, line 32, "cooccurs" should read --co-occurs--;

In column 14, line 63, "-" should read --+--.

Signed and Sealed this

Twenty-first Day of December, 1993

Attest:

Bruce Lehman

BRUCE LEHMAN

Attesting Officer

Commissioner of Patents and Trademarks

UNITED STATES PATENT AND TRADEMARK OFFICE

CERTIFICATE OF CORRECTION

PATENT NO. : 5,011,596
DATED : April 30, 1991
INVENTOR(S) : Douglas R. Shaw, et. al.

It is certified that error appears in the above-indentified patent and that said Letters Patent is hereby corrected as shown below:

On the Title page, item [75], inventors: add R. Scott Stephens, Auburn, Washington, as coinventor.

Signed and Sealed this

Twenty-eighth Day of June, 1994

*Attest:*

Bruce Lehman

BRUCE LEHMAN

*Attesting Officer*

*Commissioner of Patents and Trademarks*